US009903644B2

(12) United States Patent
Spivey et al.

(10) Patent No.: US 9,903,644 B2
(45) Date of Patent: Feb. 27, 2018

(54) METHOD AND APPARATUS FOR COOLING A FLUID BEVERAGE BELOW A BEVERAGE'S FREEZING POINT

(71) Applicant: Buz Box, LLC, Charleston, SC (US)

(72) Inventors: Michael W Spivey, Charleston, SC (US); Johnny A. Melton, Jr., Charleston, SC (US); William E. Craver, III, Sullivan's Island, SC (US)

(73) Assignee: Buz Box, LLC, Charleston, SC (US)

( * ) Notice: Subject to any disclaimer, the term of this patent is extended or adjusted under 35 U.S.C. 154(b) by 286 days.

(21) Appl. No.: 14/801,055

(22) Filed: Jul. 16, 2015

(65) Prior Publication Data

US 2015/0323246 A1 Nov. 12, 2015

Related U.S. Application Data

(63) Continuation-in-part of application No. 13/742,307, filed on Jan. 15, 2013, now abandoned.

(51) Int. Cl.
*F25D 31/00* (2006.01)

(52) U.S. Cl.
CPC ..... *F25D 31/007* (2013.01); *F25D 2331/803* (2013.01); *F25D 2331/809* (2013.01); *F25D 2400/02* (2013.01); *F25D 2500/02* (2013.01)

(58) Field of Classification Search
CPC ..... F25D 31/007; F25D 2400/28; F25D 2331/803
See application file for complete search history.

(56) References Cited

U.S. PATENT DOCUMENTS 4,704,875 A * 11/1987 Kieler ..... F25D 3/08 220/555
4,747,274 A * 5/1988 Duemmig-Zitzmann ..... B65D 81/383 62/371
4,883,169 A * 11/1989 Flanagan, Jr. ..... B65D 71/0003 206/170

* cited by examiner

*Primary Examiner* — Cassey D Bauer
(74) *Attorney, Agent, or Firm* — J. Bennett Mullinax, LLC

(57) ABSTRACT

The present invention relates to a method and apparatus for super-cooling a contained fluid by exposing a portion of the contained fluid to a temperature below a freezing point of the liquid while exposing a second portion of the contained fluid to a warmer temperature. The present invention establishes a temperature differential between the ambient air or fluid temperature within the cooler and a portion of a receiving element which receives a beveraged container. By creating a temperature differential, convection flow of the beverage within the packaged beverage occurs allowing the liquid beverage to achieve a temperature below its freezing point while being maintained in a liquid state.

28 Claims, 11 Drawing Sheets

METHOD AND APPARATUS FOR COOLING A FLUID BEVERAGE BELOW A BEVERAGE'S FREEZING POINT

RELATED APPLICATIONS

This application is a continuation-in-part of U.S. application Ser. No. 13/742,307 filed on Jan. 15, 2013 and which is incorporated herein by reference.

FIELD OF THE INVENTION

The present disclosure relates to a method and apparatus that cools a fluid below its freezing point while maintaining the fluid in a liquid state by exposing a portion of a fluid container to a cooling substance. The process of cooling a fluid below its freezing point while maintaining its liquid state is known as super-cooling.

Contained fluids have been known to reach super-cooled temperatures especially when the container is smooth and devoid of foreign particulate and the fluid and container are exposed to a cooling means capable of reaching a temperature below the freezing point of the contained liquid.

Modern beverage containment methods include the manufacture of unique containers for each contained beverage. Health and safety standards often dictate beverage liquids to be of pure, filtered nature. Pure, filtered liquid in a new container tends to provide the necessary conditions for super-cooling to occur.

Embodiment of the present disclosure relates to both mechanical and portable containers that cause a contained fluid(s) to be super-cooled by the exposing an upper surface portion of the container to a first temperature by a cooling substance while a lower surface portion of the container is exposed to a second warmer temperature, thereby establish convection induced movement of the liquid beverage which enables the beverage to reach temperatures below a beverage freezing point and still in a liquid state.

SUMMARY OF THE INVENTION

The present invention relates to a method and apparatus for super-cooling a contained fluid by exposing a first portion of the contained fluid to a cooling substance while leaving a second portion of the contained fluid uncooled.

On exemplary embodiment of the container includes three sections: an insulated upper chamber, referred to as a cooling chamber and which is adapted for holding or receiving a cooling substance; a second, lower chamber, referred to as the uncooled chamber; and at least one hollow chamber that extends through and is in contact with both cooling and uncooled chambers. The hollow chamber, referred to as a containment chamber, receives the contained (i.e., bottled or canned or otherwise contained) fluid that is to be partially super-cooled. A horizontally oriented plane divides the cooling chamber and the uncooled chamber. In some embodiments the containment chamber is oriented at an angle to the horizontal plane, so that the containment chamber extends through the upper (cooled) and lower (uncooled) chamber(s).

The present invention works by causing both convection and super cooling. Convection is achieved by exposing only part of the contained fluid to a cooling substance. Placing the contained fluid in the invention's hollow containment chamber exposes the contained fluid to both the upper cooling chamber and the lower uncooled chamber. In this manner the fluid is exposed to a temperature differential which results in convection. That is, the contained liquid moves from a lower warmer position to an upper region of the contained liquid when the liquid is cooled, sinks, and is reheated.

The action of super-cooling is achievable because contained fluids such as currently marketed bottled or canned beverages are of a purity that more easily permits super-cooling. Super-cooling can occur more easily when a fluid that is devoid of particulates is cooled to a temperature below its freezing or crystallization point. Any liquid lacking of particulates can be cooled to a temperature that is below that liquid's freezing point because it is the presence of particulates in liquids that promotes crystallization. Thus a contained fluid in a clean, smooth container—for example a bottled, canned, pouched, paperboard or similar packaged beverage—could be super-cooled, dropping to a below-freezing temperature. The present invention receives such contained fluids and causes this super-cooling. Two aspects of the present invention, the super-cooling plus the aforementioned convection, keep the contained fluids in their super-cooled, liquid state. In a context of beverages, the present invention provides a container for super-cooling and storing a contained fluid (for example a beverage) for a convenient period of time in which beverages may be stored and consumed.

One skilled in the art will realize that a cooling substance may include a powered cooling system such as a refrigerant and compressor combination or may be a chemical combination that produces low temperatures such as rock salt and ice or the use of dry ice.

The present invention offers improvements to the prior art by permitting super-cooling of contained fluids to extremely chilled liquid states while avoiding solid freezing. It also keeps contained fluids separate from any cooling substance (such as ice-and-rock-salt mixtures), allowing, far example, enjoyment of a canned or bottled beverage which has no taste of rock salt, and with no unwanted ice or water on the beverage bottle or can.

It is a further aspect of at least one embodiment of the present invention to provide for an apparatus for partially super-cooling a packaged beverage, comprising at least one upper chamber and at least one lower chamber, between which at least one receptacle for a contained fluid resides; a portion which separates the upper chamber and the lower chamber, the upper chamber engaged with a cooling means; the packaged beverage engaging both the upper chamber and a portion of the container in thermal communication with the lower chamber, such that the packaged beverage is in partial contact with the cooling substance.

It is a further aspect of at least one embodiment of the present invention to provide for an apparatus of a freezer further defining plurality of receptacles, each receptacle having an inner surface, an outer surface, and a longitudinal axis; with an axis disposed at an angle between 20 and 80 degrees and more preferably about 45° in reference to a horizontal plane, the receptacle defining an area sufficient to receive a contained fluid.

It is a further aspect of at least one embodiment of the present invention to provide for a freezer for cooling packaged beverages to a temperature below a freezing point of the beverage while maintaining the beverage in a liquid state comprising; a mechanical freezer unit defining an interior volume and an opening for accessing the interior volume, a plurality of shelves positioned within the interior volume, each shelf further adapted for holding a plurality of packaged beverages at an angle of between about 35° to about 55° relative to a horizontal reference plane and within a receiving element supported by the shelf, each receiving element further adapted for positioning a packaged beverage so that a first surface length of the packaged beverage is exposed to cooled air within the freezer interior; a heat source in communication with a base of each receiving element, said heat source adapted for increasing a temperature of at least a portion of a second surface length of the packaged beverage to a temperature above the temperature of the cooled air within the freezer; wherein, when a packaged beverage container is placed within the receiving element, the temperature differential between the upper length of the beverage container and the lower length of the beverage container creates a convection current within the liquid contents of the beverage container, thereby allowing the beverage to stay in a liquid state while maintained at a temperature below a freezing point of the beverage.

It is a further aspect of at least one embodiment of the present invention to provide for the freezer in which a receiver element has a heat source that is either resistive heating strip within the receiving element or a light bulb.

It is a further aspect of at least one embodiment of the present invention to provide for the freezer in which a receiving element has a heat source supplied by warm air generated by operation of the freezer and distributed within a plenum defined by an interior of the shelves.

It is a further aspect of at least one embodiment of the present invention to provide for a process of cooling a beverage below a freezing point of the beverage while maintaining the beverage in a liquid state comprising the steps of:

providing a freezer; establishing an ambient temperature within an interior of the freezer and at a temperature below a freezing point of a packaged beverage; placing the packaged beverage within the freezer, the package beverage positioned at an angle of between about 30 degrees to about 60 degrees, relative to a horizontal reference plane; maintaining at least a portion of a lower surface of the positioned beverage container at a temperature greater than the ambient temperature within the freezer, thereby creating a temperature differential between an upper surface of the positioned beverage container at a lower system of the positioned beverage container; establishing a convection flow of the beverage within the packaging, the convection flow rate being at a velocity sufficient to prevent freezing of the beverage.

It is a further aspect of at least one embodiment of the present invention to provide for the beverage cooling process wherein said step of maintaining a temperature of a lower section further defines using a resistance heat strip or a light bulb, or infrared heat source in communication with a lower surface of the positioned beverage container.

It is a further aspect of at least one embodiment of the present invention to provide for the process of cooling a beverage includes the step of maintaining a temperature of a lower surface of the packaged beverage container by supply a source of warm air generated from the operation of the freezer to a lower surface of the positioned beverage containers.

It is a further aspect of at least one embodiment of the present invention to provide for the process of cooling a beverage wherein the packaged beverage container is placed within a receiving element positioned within the freezer, the receiving element adapted for warming a lower portion of the beverage within the beverage container to a temperature greater than an upper portion of the beverage.

It is a further aspect of at least one embodiment of the present invention to provide for the process of cooling a beverage wherein a shelf defines a plenum within an interior of the shelf, the plenum in communication with an air source and in further communication with a base of a receiving element and wherein the receiving element may further define an insulated region surrounding of a least a portion of the base of the receiving element.

It is a further aspect of at least one embodiment of the present invention to provide a receiving element for holding a beverage which defines a heat source, and optionally insulation surrounds at least a portion of the heat source defined within the receiving element.

It is a further aspect of at least one embodiment of the present invention to provide for the process of cooling a beverage wherein the step of establishing an ambient temperature further includes supplying a mixture of ice and salt to an upper surface of the positioned beverage.

It is a further aspect of at least one embodiment of the present invention to provide for the process of cooling a beverage wherein the ambient temperature within a freezer is at least about 10 degrees Fahrenheit (F) below the freezing point of the packaged beverage.

It is a further aspect of at least one embodiment of the present invention to provide for the process of cooling a beverage wherein a temperature differential of least about 3° F. is maintained between a first length of the beverage container and a second opposite length of the beverage container.

The details of one or more variations of the instant subject matter are set forth in the accompanying drawings and the description below. Other features and advantages of the instant subject matter will be apparent from the description and drawings, and from the claims.

DESCRIPTION OF DRAWINGS

The accompanying drawings, which are incorporated in and constitute part of this specification, show certain aspects of the instant subject matter and, together with the description, help explain some of the principles associated with the disclosed embodiments and implementations. One skilled in the art will understand that a container-apparatus can take various forms and shapes. It is described here as a rectangular volume for purposes of simplicity. In the drawings.

DETAILED DESCRIPTION OF DRAWINGS

Reference will now be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents. Other objects, features, and aspects of the present invention are disclosed in the following detailed description. It is to be understood by one of ordinary skill in the art that the present discussion is a description of exemplary embodiments only and is not intended as limiting the broader aspects of the present invention, which broader aspects are embodied in the exemplary constructions.

In describing the various figures herein, the same reference numbers are used throughout to describe the same material, apparatus, or process pathway. To avoid redundancy, detailed descriptions of much of the apparatus once described in relation to a figure is not repeated in the descriptions of subsequent figures, although such apparatus or process is labeled with the same reference numbers.

Figure 1:
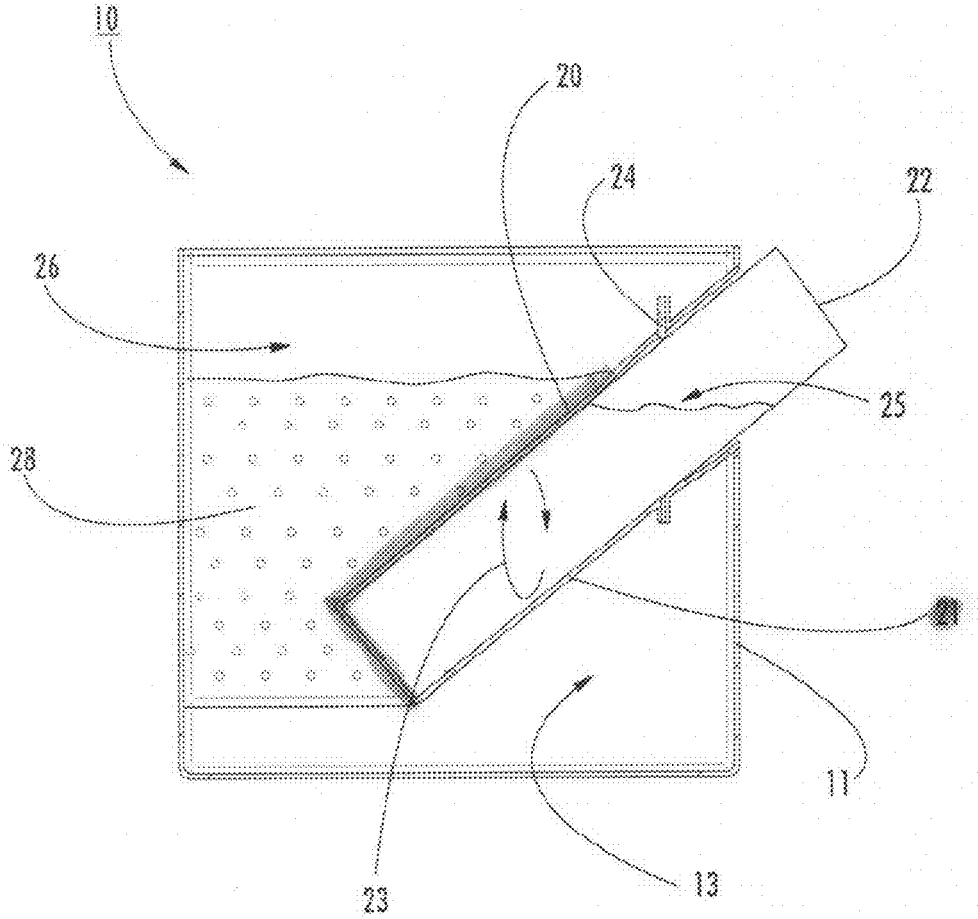
FIG. 1 is a side diagrammatic view of an example of the embodiment of the present disclosure.

FIG. 1 is a cross-section of one embodiment 10 for an apparatus and method for cooling a portion of a contained fluid is described. The fluid-cooling apparatus comprises an enclosure 11. The enclosure 11 further comprises an upper chamber 26 and a lower chamber 13. A containment chamber 22 is partially surrounded by walls of the upper chamber 20 and is further surrounded by walls 21 of the lower chamber 13. A cooling substance creates a bath 28 contained within the upper chamber 26. The bath is capable of producing temperatures below the freezing point of the fluid to be cooled. The lower chamber 13 remains empty or uncooled. Fluid 25 in the containment chamber 22 is partially cooled by being partially surrounded by the cooling bath 28 which surrounds the upper portion of the containment chamber 22. The portion of the containment chamber 22 that is in contact with the wall 21 is not cooled. By convection, fluid 25 in the containment chamber 22 will move from relatively warmer areas to relatively cooler areas as illustrated by arrows 23. A liquid of significant water composition in a clean, smooth container, devoid of particulate that may cause crystallization, in combination with movement of the fluid caused by the aforementioned convection, will be cooled below the freezing point of the liquid while maintaining a liquid state.

Gaskets 24 reside between walls 21 so that the majority of the containment chamber 22 and the fluid 25 contained therein is insulated from ambient temperature. The containment chamber 22 is made of a rigid material that conducts cold from the cooling bath 28 to the interior of the containment chamber 22, which holds the contained fluid 25. The cooling chamber partially cooling the contained liquid 25 below its freezing temperature, in conjunction with the empty lower chamber 13 provide a cool liquid for a significant duration of time, a greater period of time than if the contained fluid were submersed entirely in a cooling substance.

Figure 2:
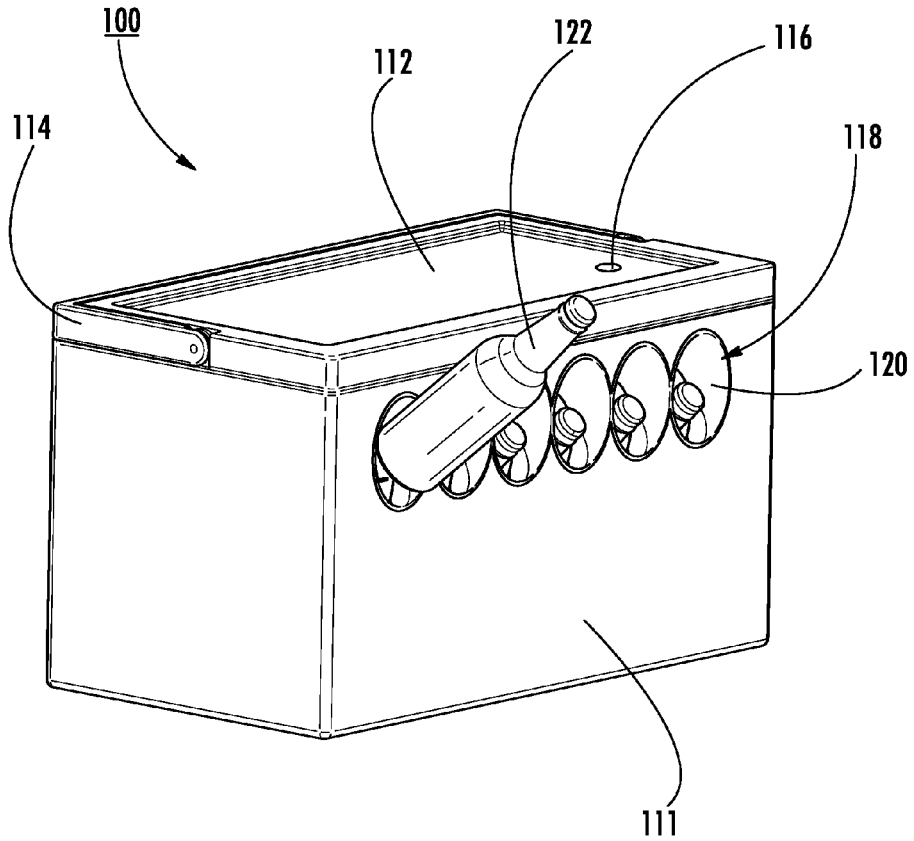
FIG. 2 is a left, front, perspective view of an example of the embodiment of the contained-fluid-cooling apparatus.

FIG. 2 shows a portable, contained-fluid-cooling apparatus 100 in its closed state with lid 112 on and handle 114 folded down. On at least one side of the outer chamber 111 at least one opening 118 joins with an integrated containment chamber 120. The integrated containment chamber 120 is shaped to hold contained fluids, for example canned or bottled beverages 122. A vent 116 provides a means of relieving pressure between the interior of the apparatus and the ambient pressure so as to allow for easy lid-opening, as a cooling process on the interior of the apparatus tends to create a pressure differential.

Figure 3:
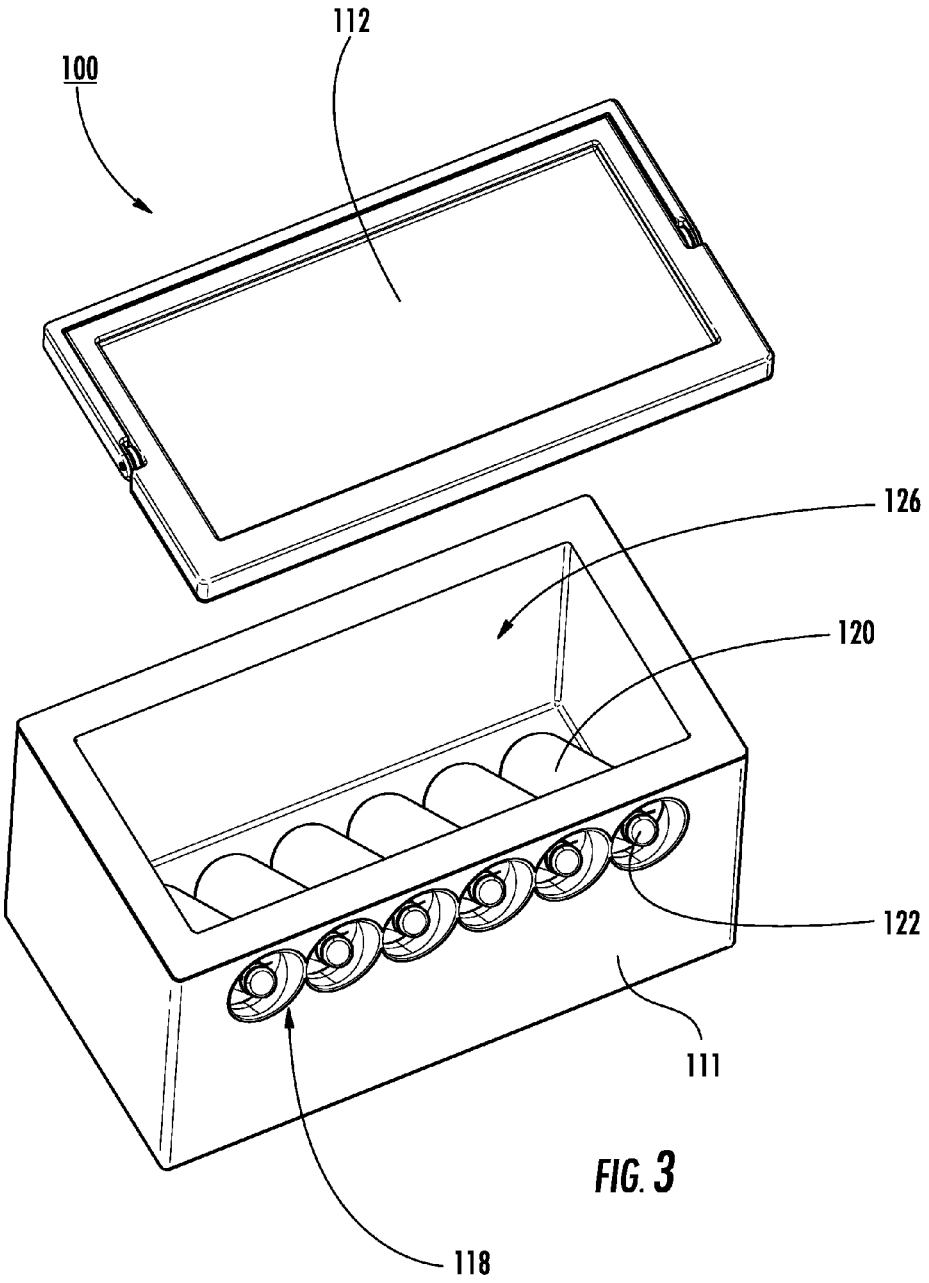
FIG. 3 is a top-perspective, partially exploded view of an example of the contained-fluid-cooling apparatus.

FIG. 3 shows the portable, contained-fluid-cooling apparatus 100 with its lid 112 removed. The upper portions of the integrated containment chamber 120 meet the upper chamber 126. An opening 118 in the outer chamber 111 receives a contained fluid 122 such as a canned or bottled beverage.

Figure 4:
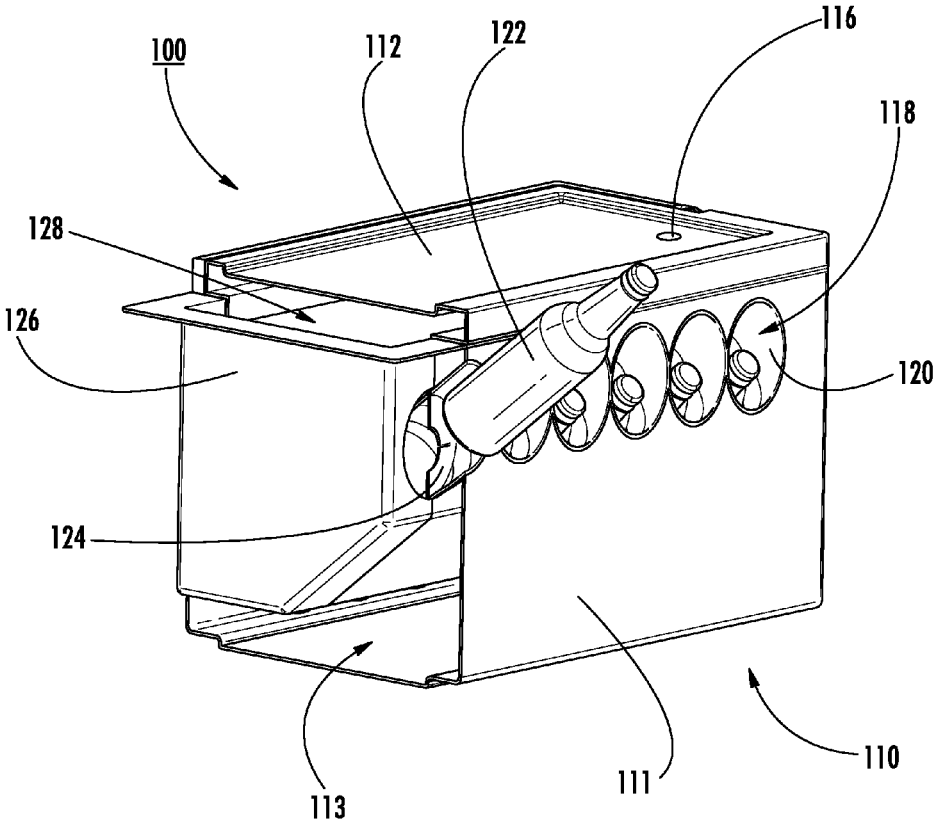
FIG. 4 is a perspective, partial cutaway view of an example of the contained-fluid-cooling apparatus.

FIG. 4 is a partial cutaway view of the apparatus 100 showing contained fluids 122 placed as intended in the integrated containment chamber 120 so that the contained fluids 122 are cooled by contact with a cooling bath 128 which surrounds a portion of the integrated containment chambers 120 in the upper chamber 126. Thus only the upper portion of the contained fluid 122 is cooled.

Gaskets 124 integrated with the integrated containment chambers 120 create a seal between the interior of the containment chambers and the exterior of the contained fluids 128 so as to keep the contained fluids 122 insulated from the ambient temperature. The integrated containment chambers 120 are made of a rigid material that conducts cold from the cooling bath 128 to the interior of the integrated containment chambers 120, where the contained fluids 122 are stored. On at least one side of the outer chamber 111 at least one opening 118 joins with an integrated containment chamber 120. The integrated containment chamber 120 is shaped to hold contained fluids 122, for example canned or bottled beverages. A gasket 124 makes a seal between the integrated containment chamber 120 and contained fluid 122. The integrated containment chambers 120 extend from an opening 118 in the outer chamber 111 into the inside of the upper chamber 126 and the lower chamber 113.

Figure 5:
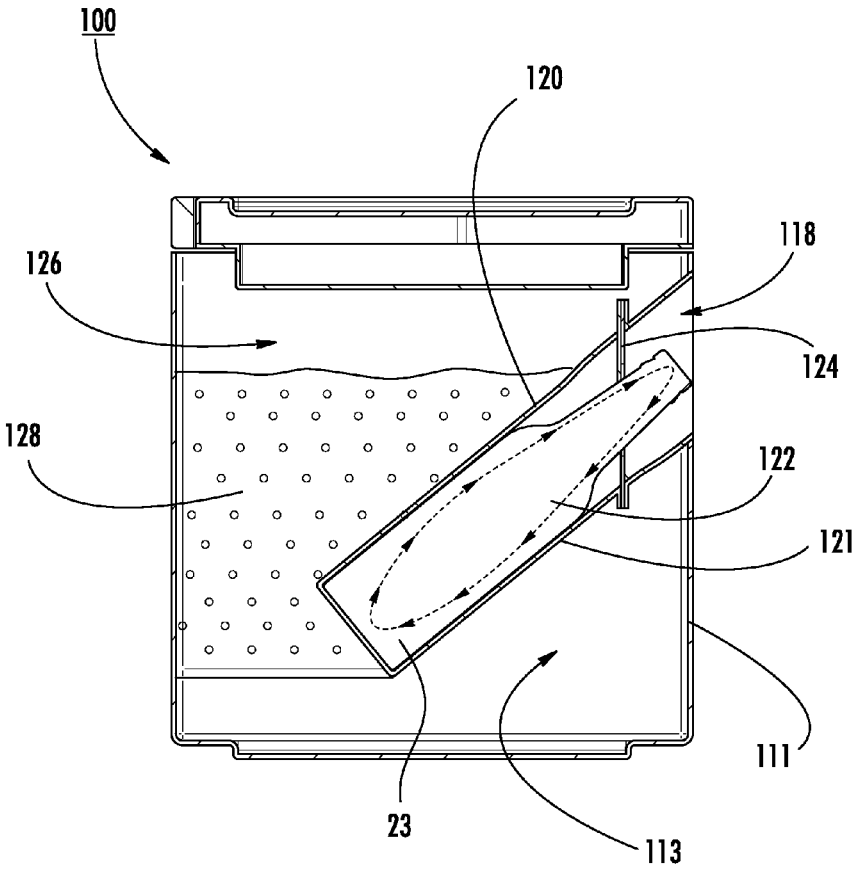
FIG. 5 is a side, orthographic section view of an example of the contained-fluid-cooling apparatus.

FIG. 5 is a cross-section of the present embodiment 100. An apparatus and method for cooling a portion of a beverage container is described. The fluid-cooling apparatus 100 comprises an enclosure 111. The enclosure 111 further comprises an upper chamber 126 and a lower chamber 113. A containment chamber 122 is partially surrounded by walls of the upper chamber 120 and is further surrounded by walls 121 of the lower chamber 113. A cooling substance creates a bath 128 that is capable of producing temperatures below the freezing point of the fluid to be cooled, and is contained within the upper chamber 126 while the lower chamber 113 remains empty and not directly cooled. A beverage container 122 in the containment chamber 118 is partially cooled by being surrounded by the cooling bath 128 which surrounds the upper portion of the containment chamber 122. The portion of the containment chamber 122 that is in contact with the wall 121 is not cooled and creates a temperature differential between opposite sites of the container 122.

In accordance with the present invention, it has been found that temperatures substantially below the freezing point of a liquid can be achieved using a chest type freezer of the type described in FIGS. 1-4. For instance, a bottled beer may be brought and maintained at a temperature of about 14.5° F. without freezing. Other beverages could be reduced to temperatures between 17° to 22° F. For instance, bottled water could be maintained between temperatures of 22 to 24° F. without being frozen.

Without being limited by theory, it is believed that the below freezing point temperatures are possible because of the kinetic energy associated with the convection movement of fluids within the packaged beverage container. It is believed that maintaining a temperature differential preferably between about 1° to about 15°, more preferably between about 5° to about 10° and still more preferably between about 6° to about 9° to a Fahrenheit scale, allows for a sufficient kinetic energy and convection current to be established while maintaining the liquid beverage at a below freezing temperature. While even a minor temperature differential between an upper surface of the packaged beverage and a lower surface of the packaged beverage will inpart a convection current, it is believed that having a temperature differential of at least about 7° degrees will provide sufficient energy in the form of convection movement of the beverage such that below freezing temperatures can be maintained.

As seen in reference to FIGS. 6-10, an apparatus and a process is provided in which a mechanical freezer may be used to establish an ambient temperature within the freezer which is below the freezing point of a packaged beverage. The packaged beverages are maintained within a receiving element 208 on an inclined shelf 206 that positions the packaged beverage 210 at an angle of between about 20° to about 70° and more preferably about 40° to about 50°, and move preferably at an angle of about 45° relative to a horizontal reference plane.

Figure 6:
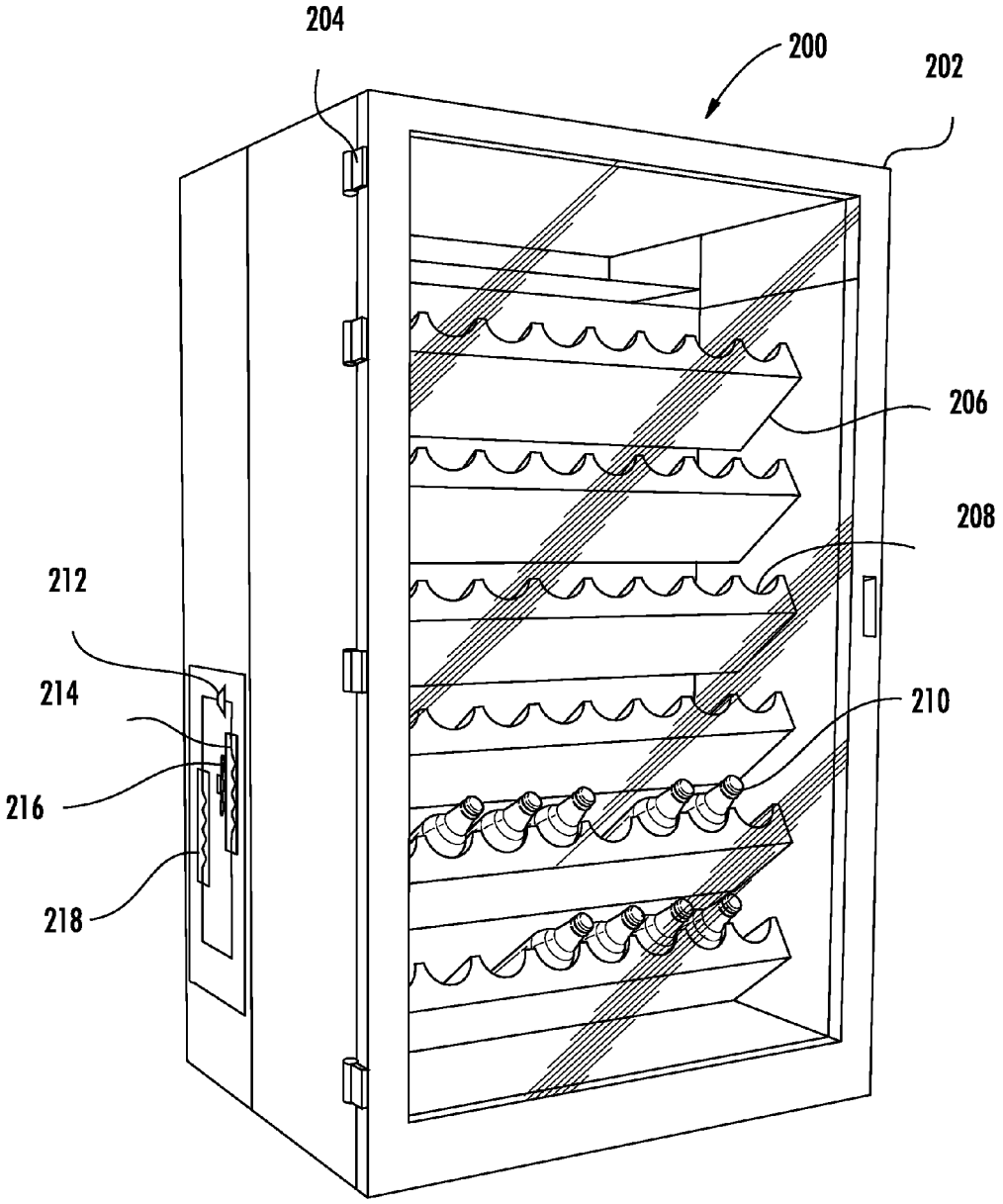
FIG. 6 is a perspective view illustrating an electric version of a freezer that can be used for lowering a packaged beverage to a temperature below the beverage's freezing point.
Figure 7:
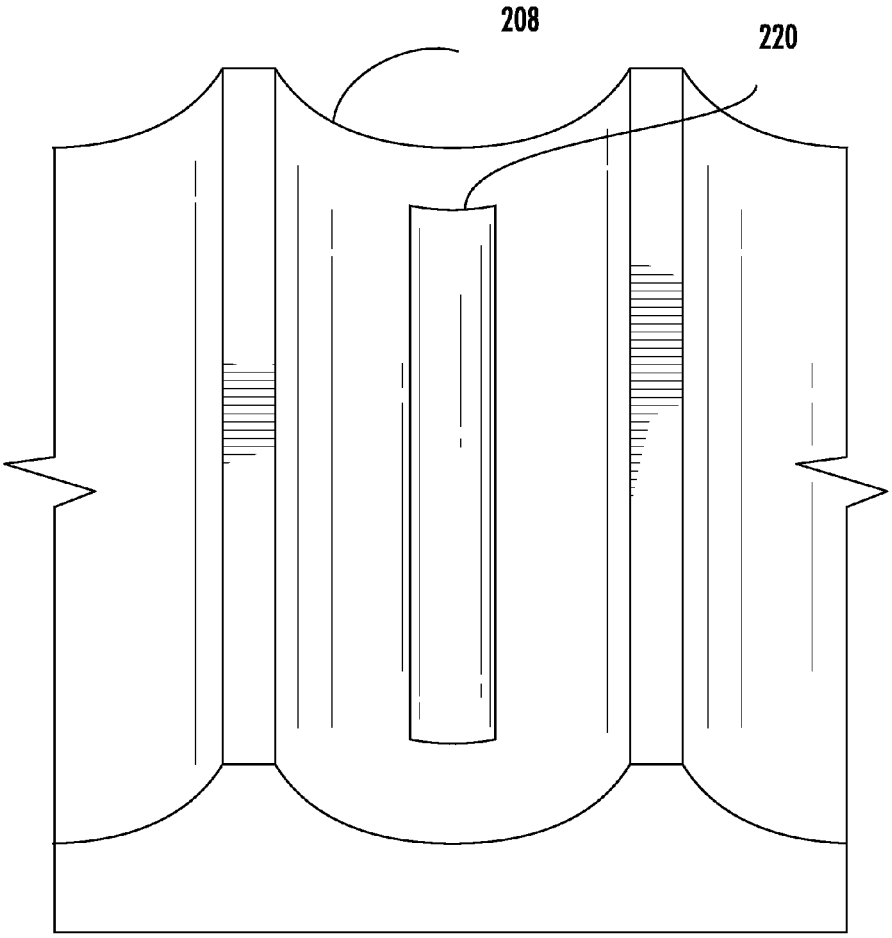
FIGS. 7-9 show various embodiments of the receiving element which retains a packaged beverage and further maintains a contact region with the beverage at a temperature greater than the ambient temperature within the freezer.

As best seen in reference to FIGS. 6 and 7, an electrically operated mechanical operated freezer 200 is seen. The freezer can have a door 202 which may be of metal or glass. Situated within the interior of the freezer are a plurality of the shelves 206, each shelf further defining a plurality of receiving elements 208 for holding a prepackaged beverage 210. While the preferred embodiment illustrates a receiving element 208 adapted for a cylindrical beverage container 210, it is noted that the receiving element can be altered to fit any desired beverage container shape. For instance, a soft drink or beer provider could have the receiving element molded in a dimension that conforms to the contours of a preferred beverage bottle. Likewise, a receiving element could be fashioned in accordance with the present teachings to receive flat sided containers such as cartons.

The operation of the cooling components of the freezer are conventional and well known within the art. As seen in reference to FIG. 6, there is a compressor 212 which directs a cooling medium to a condenser 218. From condenser 218 the cooling medium is directed to an evaporator 214 within an associated fan 216 which distributes the chilled air from operation of the evaporator unit into the interior space of the freezer 200. The distribution of chilled air within the freezer can be through air directly released into the freezer or by chilling the interior walls. The mechanical operation of any conventional freezer design can be utilized in accordance with the present invention so as to provide the necessary shelving, receiving elements, and modifications of the receiving element as described below so as to bring about a differential temperature with respect to a portion of the beverage container and the ambient air temperature which is in contact with the surface of the beverage container not in contact with the receiving element.

Figure 8:
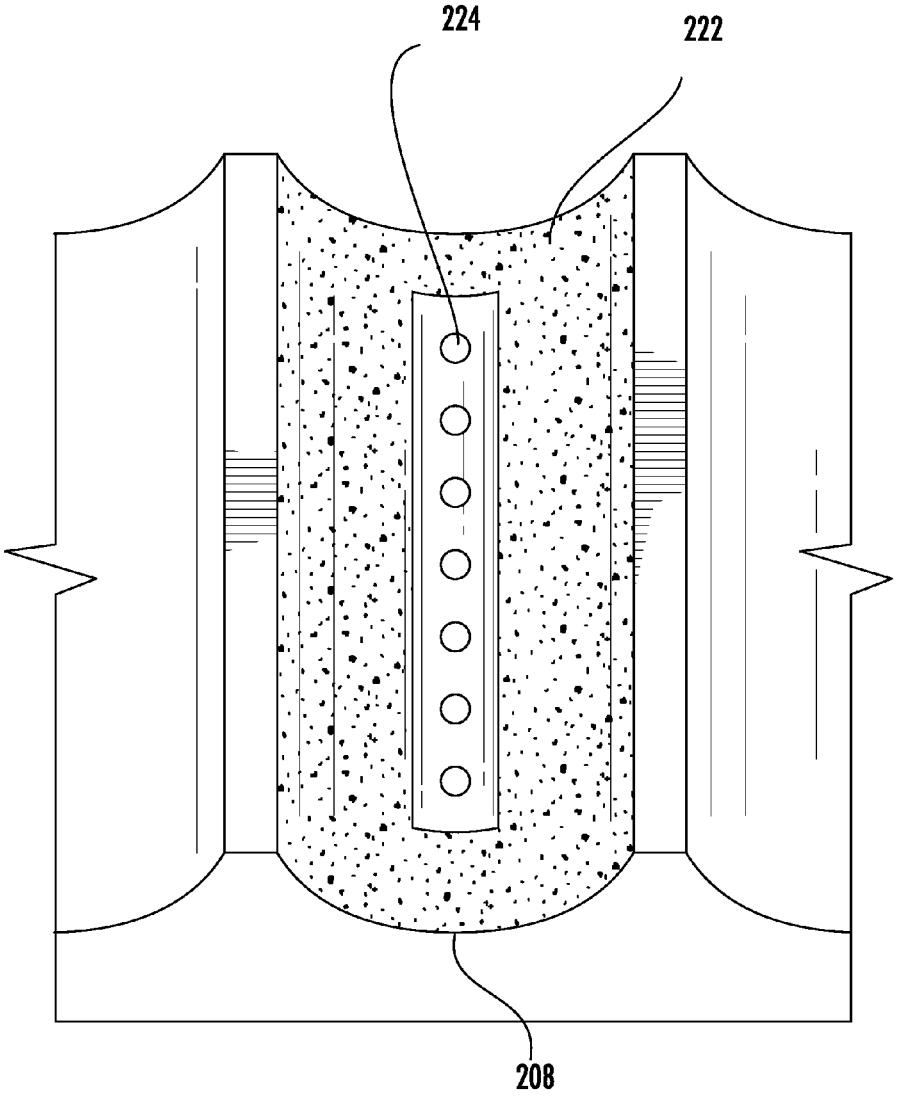
Figure 9:
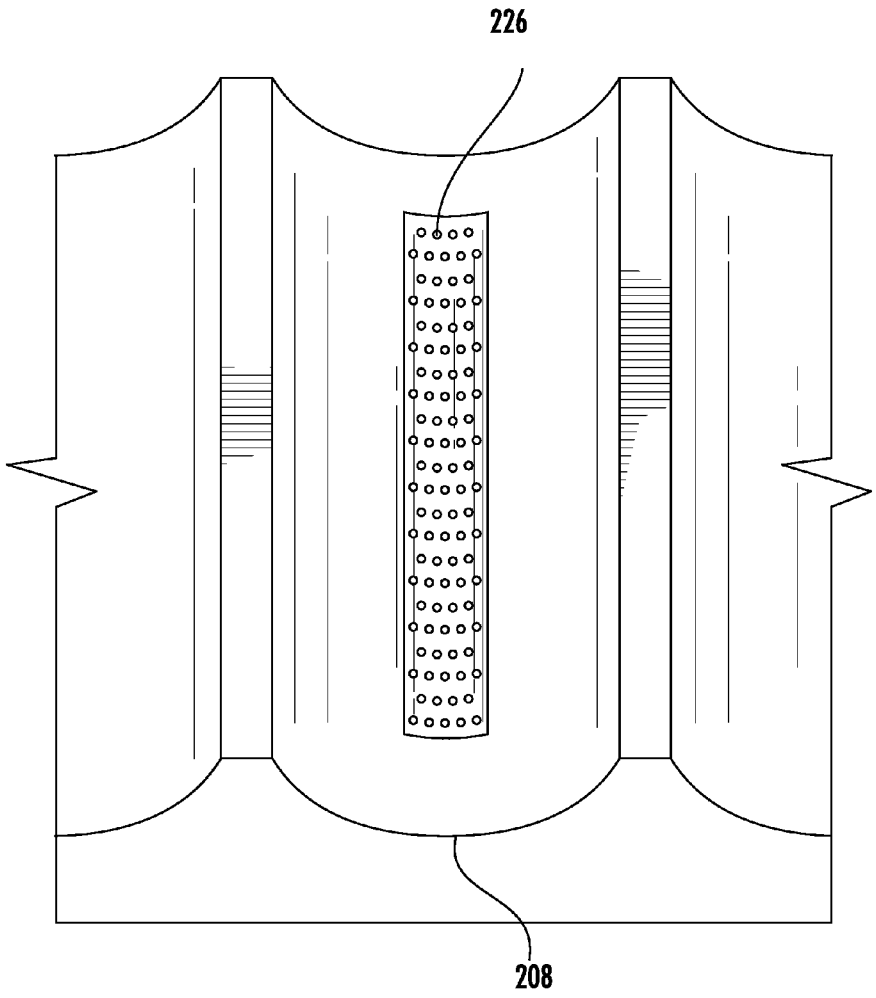

As best seen in reference to FIGS. 7-9 are various embodiments of receiving elements 208 that have been modified along a portion of the receiving element so as to bring about a temperature differential with respect to a surface of the bottle that engages the receiving element and the opposite side of the bottle. For instance, as seen in reference to FIG. 7, a strip heater 220 can be positioned within the receiving element and which would be in contact with a beverage container placed within the receiving element.

The strip heater 220 can be responsive to a thermostat and can be set at a temperature preselected for the type of beverage being placed within the receiving element. For instance, if a desired temperature differential of 7° between the ambient air temperature of the freezer and a warmer temperature established by the strip heater 220 is desired, the appropriate temperature of the strip heater can be maintained. That temperature will of course vary depending upon the nature of the contents of the packaged beverage. For instance, bottled water may have an ambient freezer temperature of 20° in which the strip heater 220 is maintained at a temperature of 27°. The temperature differential is sufficient to establish a convection flow within the packaged beverage as seen in reference to directional movement 23 seen in FIG. 1.

An alternative embodiment of the receiving element 208 can be seen in reference to FIG. 8 in which a plurality of light bulbs 224 can be used to bring about a temperature differential between any bottle or beverage container within the receiving element 208 and the opposing side of the beverage container. The bulbs 224 can be incandescent, infrared, tungsten, or other electric bulb which generates an effective amount of heat. The bulbs can be regulated by a thermostat, a rheostat, or some combination of the two such that the heat from the bulbs will establish the desired temperature differential. As seen in reference to FIG. 8, optional insulation 222 can be provided within the receiving element. The insulation 222 can be used with any of the embodiments described herein and can provide for a more energy efficient operation of the freezer unit. In addition, the insulation 222 can also provide a physical cushion with respect to the beverage container which can lessen noise and minimize possible breakage of glass containers.

Set forth in FIG. 9 is yet another alternative embodiment of a receiving element 208 in which a portion of the receiving element is in communication with a warm air outlet 226. By way of example, the outlet 226 can comprise a plurality of small apertures and are in communication with an air flow which is warmer than the ambient air temperature of the freezer. One way of providing a warm air source to the air outlet 226 can be seen in reference to the air flow pathway set forth in FIG. 10. As seen in reference to FIG. 10, an air flow pathway 232 as seen by the directional arrows is schematically indicated as flowing through the plurality of shelves 206 and the associated interior walls of the freezer. The air flow 232 is in communication with an inlet 230 positioned near a base of the freezer 200 and exits through a wall outlet 234 along an upper edge of freezer 200. The air flow 232 can be in communication with the receiving element 208 defined within each shelf. The warmer air associated with air flow can be used to raise the entire surface temperature of receiving element 208 or be a more direct communication through outlet 226 as seen in reference to FIG. 9. In addition, the air flow 232 can either use an air source external to the freezer 200, or utilize heated air displaced from the operation of the compressor and other portions of the mechanical cooling unit. Further, it is envisioned that a combined air flow using a combination of outside air and air warmed by operation of the freezer can be used to establish a temperature differential between base surface of the receiving elements 208 and the ambient air temperature within the interior of freezer 200.

A portion of the receiving element is in thermal contact with a lower surface of the beverage container. This portion of the thermal contact area can provide a means for increasing a localized temperature within the receiving element such that the heat is subsequently transferred to the packaged beverage. Suitable heating elements can include a resistance strip heater 220 (FIG. 9) which is positioned within the receiving element 206, a surface of the receiving element which contains flush or recessed infrared light sources 224 (FIG. 8) such as incandescent bulbs, tungsten bulbs, or infrared bulbs. By supplying a heat source to the lower surface of the container and/or a receiving portion of the receiving element, sufficient heat can be transferred to the contents of the packaged beverage such that a convection movement is created by temperature differentials between the upper liquid surface and lower liquid surface of the beverage. The temperature difference between a lower portion of the packaged liquid and an upper portion of the package liquidage establishing the convection movement within the container and the associated kinetic energy prevents the contents from freezing even when the contents are at a temperature that may be well below a freezing point of the packaged beverage.

Figure 10:
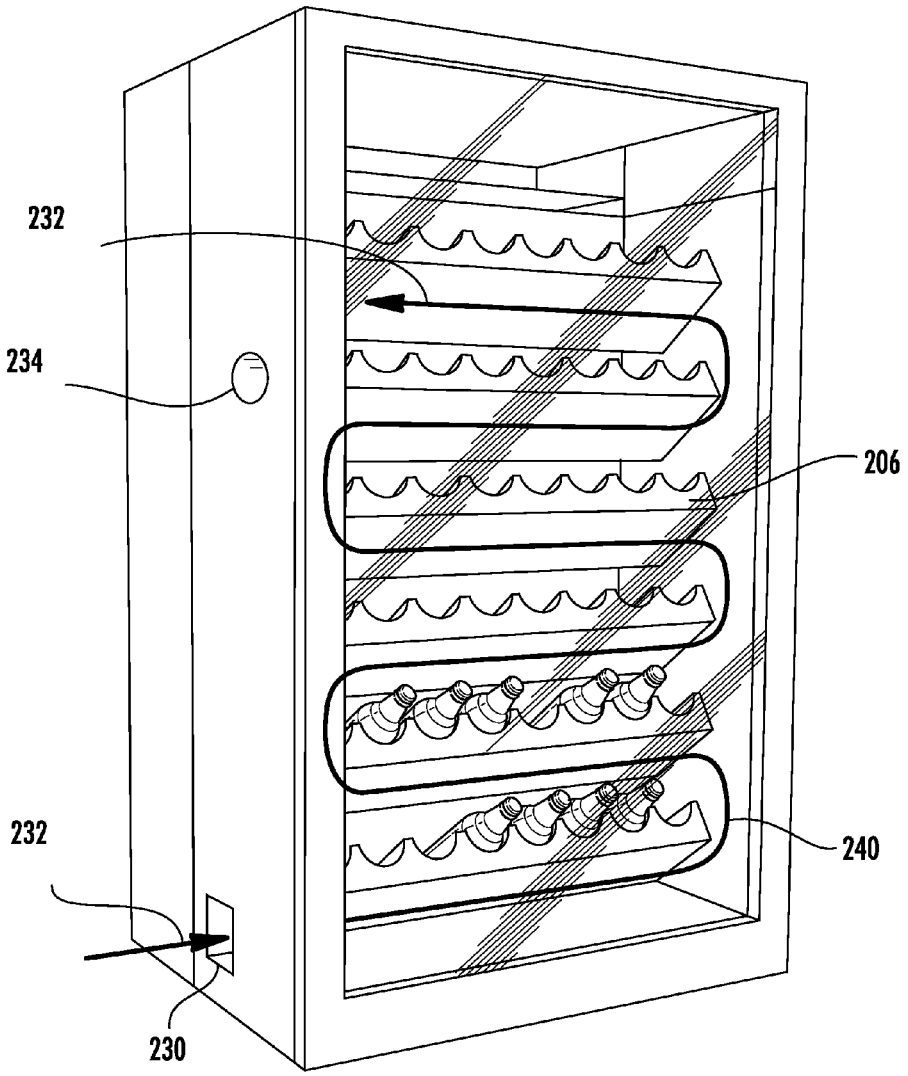
FIG. 10 illustrates an external ambient air source circulation pathway within the interior of the freezer.

An alternative embodiment and process for maintaining a packaged beverage below a freezing point can be seen in reference in FIG. 10 wherein the receiving element is in communication with a source of air that is warmer than the ambient air within the freezer. For instance, an air plenum can be defined within the shelves 206 and the receiving element 208 such that the portion of the receiving element 208 that makes contact with the beverage container is maintained at a warmer temperature than the freezer ambient temperature. The warmer air can be either air from outside the freezer or air directed from the heat generated by the compressor 212 or a combination of both. By introducing warmer air to the receiving element area, the beverage placed within the receiving element will have the corresponding adjacent surface warmed which in turn increases a localized temperature of the beverage adjacent to the corresponding interior beverage container wall. The difference between the warmer temperature and the cooler temperature of the beverage exposed to the upper portion of the packaged container will bring about the convection rotational movement of the beverage within the container.

One or more thermostats can be used to help regulate the desired temperature differential between the freezer ambient air temperature and the localized temperature within the receiving element. A suitable preprogrammed temperature profile can be established for various types of beverages depending upon the type of beverage i.e. water, beer, or soft drink, as well as make adjustments for the size of the container. Fine tuning of the temperature controls can also make allowances for the type of beverage container. For instance, highly conductive materials such as aluminum may operate at an optimal temperature values that may be different from the identical beverage packaged in a thicker glass, a plastic container, or a paper board container. As the ambient temperature in the freezer is lowered, the corresponding localized temperature within the receiving element can optionally be increased. Without undue experimentation, one of ordinary skill in the art can readily ascertain the desired temperature differentials for any particular beverage as packaged so as to achieve a desired beverage temperature.

The receiving 208 element can also be responsive to one or more sensors such as a light sensor, a proximity sensor or a mechanical switch that is engaged when a packaged beverage is placed within the receiving element. When the sensor detects that there is no beverage container present, the various types of heating mechanisms utilized for increasing the temperature within the receiving element can be turned off.

While the illustrated embodiments reflect a receiving element for holding a single beverage, it is envisioned and within in the scope of the present invention that a plurality of aligned receiving elements can be provided within a freezer such that a plurality of beverage containers can be placed end to end within a cylindrical or linear receiving, element 208. As it is known in the art, various springs or biasing members can be used to reposition a packaged beverage to a terminal end of the receiving element such that an individual can easily grasp and remove the packaged beverage. To the extent there are other beverages packaged within the receiving element magazine, the next beveraged item can then be positioned into the display and/or point of sale position.

The embodiments set forth in FIGS. 6-10 illustrate preferred embodiments of a receiving element having a heat transfer area that substantially corresponds to a portion of a length of a packaged beverage container. It is also possible to provide a heat source applied to either a partial length of the beverage container or to the beverage base. While as not as effective in establishing a convectional flow, such an arrangement would still operate to prevent the beverage contents from freezing by creating a convection movement within the container.

Figure 11:
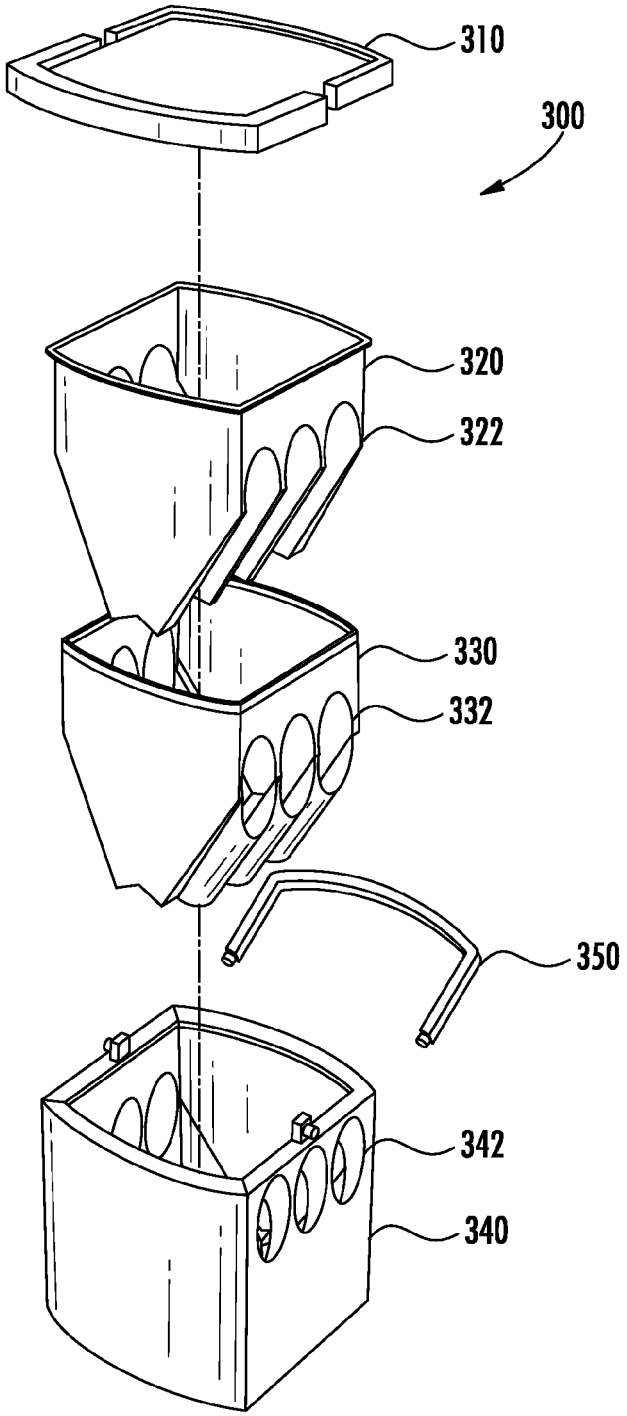
FIG. 11 is an exploded view of a multi-compartment, non-mechanical cooler that provides for cooling and maintaining a beverage below the beverage's freezing point.

As seen in reference to FIG. 11, an embodiment of a non-mechanical cooler is provided. The cooler is designed to be portable and can be used with ice and rock salt to lower enclosed beverages to a temperature below the freezing point of the beverage. The cooler 300 has a removable top 310, a water tight cooling compartment 320 which is adapted to nest within an uncooled compartment 330. Cooling compartment 320 and uncooled compartment 330 can be further secured in an insulated enclosure 340.

Cooling compartment 320 is designed to hold a mixture of ice and rock salt. It has been found that ratios of 1 cup of salt to 5 to 8 pounds of ice can achieve temperatures well below freezing. For instance, a 1 to 3 ratio of sodium chloride to ice can achieve a temperature of minus 4.0° F. As a general rule, the greater percentage of salt in the salt to ice ratio will bring about a lower temperature. The exact ratio can be influenced by the nature of the beverage. For instance, the lower temperature can be utilized for beers which would ultimately freeze at a lower temperature than for instance bottled water.

Cooling compartment 320 is sealed so that ice, salt, and melted water are entirely contained within compartment 320. Compartment 320 is placed in an engaged position with the corresponding lower uncooled compartment 330 when second in place, the curved arcuate surfaces 322 defined by upper compartment 320 will align with openings 332 in compartment 330. The mated engagement will establish a receiving sleeve that is formed between the arcuate curvature 322 and the arcuate member 332. In an assembled configuration, apertures 342 of base 340 are aligned with corresponding apertures 332 and 322 of corresponding bases 330 and 320. A beveraged container, not illustrated, can be inserted into aperture 342 and is inter-engaged between an upper half of a cylinder formed by arcuate surface 322 and a lower half of arcuate surfaces 332. The beverage is exposed to a cooling medium contained in the opening defined by compartment 320 that allows the cooling medium to achieve a temperature below freezing. The cooling medium is transferred along the curved surface of opening 322 and cools an upper surface of an enclosed beverage. The lower surface 322 is not cooled and is at a warmer temperature. The temperature differential brings about a convection movement within the beverage. With the components being housed within an insulated base 342, the cooler can provide for at least 24 hours of below freezing temperature cooling of liquids placed in the container such as bottled water, soft drinks, beer, juices, and similar beverages.

In this embodiment, the temperature differential is largely controlled by the temperature present within the interior of compartment 330. Since compartment 330 is not directly exposed to the cooling medium present within compartment 320, a temperature differential is created and will vary depending upon the ambient air temperature in which the cooler is stored and maintained.

One having ordinary skill in the art will recognize that the greater the temperature differential that is established between an upper layer of the liquid beverage and a lower layer portion of the liquid beverage, the greater the amount of convection and hence kinetic energy will be established within the container. As a general rule, the greater the temperature differential, the lower the temperature relative to the freezing point that can be established. Without undue experimentation, one of the ordinary skill in the art can establish the appropriate temperature differentials that are needed given the variation in container shapes, container materials, beverage contents, desired below freezing temperature point for the liquid beverage, and the amount of kinetic energy needed to be supplied by the temperature differential induced convection. In general, a lower sub-freezing point for the beverage will require a greater temperature differential in order to maintain the necessary kinetic energy.

The freezing point (° C.) of beer=(−0.42×A)+(0.04×E)+0.2, where A is the percent of alcohol content by weight, and E is the original gravity of the wort (° Plato). Therefore, each 1% increase in alcohol content lowers the freezing point by 0.42° C. and each increase in gravity of 1° Plato raises it by 0.04° C. Thus, no beer will freeze at −1° C., and products at higher alcohol concentrations (including high-gravity brews prior to dilution) will withstand even lower temperatures.

TABLE 1

| | Cargo type | Freezing point in ° F. |
|---|---|---|
| 1 | Carbonated water | 31.5 |
| 2 | Fizzy lemonade | 31.1 |
| 3 | Fizzy orange | 30.0 |
| 4 | Tomato juice | 29.4 |
| 5 | Apple juice | 29.0 |
| 6 | Mango juice | 29.0 |
| 7 | Unfermented rhubarb juice | 28.6 |
| 8 | Malt beer, ordinary | 28.5 |
| 9 | Vollbier, pale | 28.3 |
| 10 | Unfermented sour cherry juice | 28.1 |
| 11 | Unfermented redcurrant juice | 27.8 |
| 12 | German Pilsner | 27.6 |
| 13 | Bock beer, pale | 26.5 |

Set forth above in Table 1 are freezing points of various types of beverages. All these beverages can be brought to and maintained at a temperature. It is believed to be at least about 10 degrees below the freezing point of the beverage by creating a sufficient temperature differential within the beverage container to bring about convection movement of the beverage. The presence or absence of carbonation, alcohol content, sugar content, and the presence of other solutes can all have an impact on the normal freezing point of a beverage. As a general rule, the more materials such as sugars, alcohol, and dissolved gases such as carbonation that are present within a beverage, the lower the normal freezing point of the beverage.

Although preferred embodiments of the invention have been described using specific terms, devices, and methods, such description is for illustrative purposes only. The words used are words of description rather than of limitation. It is to be understood that changes and variations may be made by those of ordinary skill in the art without departing from the spirit or the scope of the present invention which is set forth in the following claims. In addition, it should be understood that aspects of the various embodiments may be interchanged, both in whole, or in part. Therefore, the spirit and scope of the appended claims should not be limited to the description of the preferred versions contained therein.

That which is claimed:

1. A cooler for maintaining a packaged beverage below a freezing point of the beverage and in a liquid state comprising:

a housing defining an interior volume which is adapted for being cooled to a temperature below a freezing point of a beverage:

a plurality of receiving elements within the housing, the plumbing of receiving elements adapted for receiving a packaged beverage and positioning the beverage at about a 35 degree to about a 55 degree angle relative to a horizontal reference plane, the plurality of receiving elements further comprising an upper wall corresponding to a space opposite a first side wall of a beverage container, and rear wall, corresponding to a space opposite a bottom wall of a beverage container, the receptacle upper wall and the receptacle bottom wall being in contact with the interior volume, the receptacle furthering defining a lower wall opposite the upper wall, the receptacle lower wall not being in contact with the interior volume of the cooler and the receptacle lower wall having a temperature which is warmer than the receptacle upper wall and rear wall when the interior volume is at a temperature below a freezing point of a beverage;

wherein, a temperature differential between the upper wall of the receiving element and the lower wall of the receiving element establishes within the packaged beverage a convection flow, the convection flow allowing the beverage to be maintained at a temperature below the freezing point and in a liquid state.

2. The cooler according to claim 1 wherein the angle in which the beverages are positioned is substantially about 45 degrees.

3. The cooler according to claim 1 wherein the temperature differential between the interior volume and a portion of the receiving element is between a range of 5° to 15° Fahrenheit.

4. The cooler according to claim 1 wherein the receiving element is in the form of a cylindrical sleeve.

5. The cooler according to claim 1 wherein the receiving element defines an arcuate base for receiving a packaged beverage and an upper surface of the packaged beverage is in direct communication with a cooling medium which maintains a temperature differential such that the first side wall of the packaged beverage container is colder than an opposite side wall of the beverage container in contact with the receiving element.

6. The apparatus of claim 5 wherein the contained fluid is a canned or bottled beverage.

7. The apparatus of claim 5 wherein the receiving element comprises a gasket that seals between the inner surface of the receptacle and the outer surface of the packaged beverage container, therefore providing a barrier between the ambient air and the inside of the receiving element.

8. A method of partially super-cooling a packaged beverage comprising:

obtaining a packaged beverage, and inserting the packaged beverage into one of the plurality of receiving elements of claim 1, when the interior volume is below a freezing point of the packaged beverage.

9. A freezer for cooling packaged beverages to a temperature below a freezing point of the beverage while maintaining the beverage in a liquid state comprising;

a freezer unit defining an interior volume and an opening for accessing the interior volume;

a plurality of shelves positioned within the interior volume, each shelf further adapted for holding a plurality of packaged beverages at an angle of between about 40° to about 50° relative a to horizontal reference plane and within a receiving element of the shelf, each receiving element further adapted for positioning each said packaged beverage so that a first surface length of the packaged beverage is exposed to a cooling medium within the freezer interior;

a heat source in communication with a base of each receiving element, said heat source adapted for increasing a temperature of at least a portion of the second surface length of the packaged beverage to a temperature above the temperature of the cooling medium within the freezer;

wherein, when a packaged beverage container is placed within the receiving element, the temperature differential between the upper length of the beverage container and the lower length of the beverage container creates a convection current within the liquid contents of the beverage container, thereby allowing the beverage to stay in a liquid state while maintained at a temperature below a freezing point of the beverage.

10. The freezer according to claim 9 wherein the heat source is a resistive heating strip within the base of the receiving element.

11. The freezer according to claim 9 wherein the heat source is supplied by warm air generated by operation of the freezer and distributed within a plenum defined by an interior of the shelves.

12. The freezer according to claim 9 wherein the heat source is a light bulb.

13. A process of cooling a beverage below a freezing point of the beverage while maintaining the beverage in a liquid state comprising the steps of:

providing a freezer;

establishing an ambient temperature within an interior of the freezer and at a temperature below a freezing point of a packaged beverage;

placing the packaged beverage within the freezer, the package beverage positioned at an angle of between about 40° to about 50°, relative to a horizontal reference line;

maintaining a lower surface of the positioned beverage container at a temperature greater than a bottom of the positioned beverage container and at least a portion of the upper surface of the beverage container, thereby creating a temperature differential between a portion of the beverage at an upper surface of the positioned beverage container and a portion of the beverage at a lower surface of the positioned beverage container;

establishing a convection flow of the beverage within the packaged beverage, the convection flow having a velocity sufficient to prevent freezing of the beverage.

14. The process according to claim 13 wherein said step of maintaining a temperature of a lower section further defines using a resistance heat strip in communication with a lower surface of the positioned beverage container.

15. The process according to claim 13 wherein said step of maintaining a temperature of a lower surface of the packaged beverage further comprises using an infrared heat source.

16. The process according to claim 13 wherein said step of maintaining a temperature of a lower surface of the packaged beverage container further defines supplying a source of warm air to a lower surface of the positioned beverage containers.

17. The process according to claim 13 wherein the step of placing the beverage container in the freezer further defines placing the packaged beverage container within a receiving element which defines a slot that allows exposure of ambient freezer air to the beverage container.

18. The process according to claim 17 wherein the receiving element is further supplied by a shelf supported within the freezer.

19. The process according to claim 18 wherein the shelf further defines a plenum within an interior of the shelf, the plenum in communication with a heated air source and in further communication with a base of the receiving element.

20. The process according to claim 18 wherein the receiving element further defines an insulated region surrounding of a least a portion of a resistance heater.

21. The process according to claim 19 wherein the receiving element further defines an outlet in communication with the plenum.

22. The process according to claim 21 wherein an insulation material surrounds at least a portion of the outlet defined within the receiving element.

23. The process according to claim 13 wherein the freezer is a mechanical freezer.

24. The process according to claim 13 wherein the freezer is a non mechanical portable cooler.

25. The process according to claim 24 wherein said step of establishing an ambient temperature further included supplying a mixture of ice and salt to an upper surface of the positioned beverage.

26. The process according to claim 25 wherein the freezer is a portable cooler.

27. The process according to claim 13 wherein the ambient temperature within the freezer is at least about 10 degrees below the freezing point of the packaged beverage.

28. The process according to claim 13 wherein the temperature differential is at least about 3 degrees.

* * * * *